United States Patent [19]

Browning et al.

[11] Patent Number: 4,642,945

[45] Date of Patent: Feb. 17, 1987

[54] ENTERTAINMENT STRUCTURE

[75] Inventors: Michael R. Browning, Flinders; Evelyn I. Cronk, Gardenvale; Phillip A. Adams, Hawthorn, all of Australia

[73] Assignee: Cinemotion Pty. Ltd., Toorak, Australia

[21] Appl. No.: 752,259

[22] Filed: Jul. 3, 1985

[30] Foreign Application Priority Data

| | | | |
|---|---|---|---|
| Jul. 3, 1984 | [AU] | Australia | PG5820 |
| Oct. 19, 1984 | [AU] | Australia | PG7714 |
| Oct. 19, 1984 | [AU] | Australia | PG7715 |

[51] Int. Cl.[4] ..... E04H 3/22; A63G 31/16; G03B 21/56; G03B 31/00

[52] U.S. Cl. ..... 52/10; 52/6; 272/18; 350/125; 352/36

[58] Field of Search ..... 52/10, 9, 7, 6; 272/21, 272/22, 16, 17, 18; 350/125; 352/36

[56] References Cited

U.S. PATENT DOCUMENTS

| | | | |
|---|---|---|---|
| 981,672 | 1/1911 | Napp | 272/17 |
| 1,517,774 | 12/1924 | Duprey | 52/10 |
| 1,789,680 | 1/1931 | Gwinnett | 272/18 |
| 2,700,798 | 2/1955 | Perrottet | 52/10 X |
| 2,753,818 | 7/1956 | Green | 272/16 X |
| 2,861,806 | 11/1958 | Disney | 272/18 |
| 3,394,505 | 7/1968 | Rife | 52/10 |
| 3,399,501 | 9/1968 | Rossman | 52/10 |
| 3,420,605 | 1/1969 | Kipping | 350/125 X |
| 3,468,533 | 9/1969 | House, Jr. | 272/18 |
| 3,469,837 | 9/1969 | Heilig | 272/18 X |
| 4,022,522 | 5/1977 | Rain | 350/125 X |
| 4,066,256 | 1/1978 | Trumbull | 272/18 |
| 4,461,470 | 7/1984 | Astroth et al. | 272/17 |

FOREIGN PATENT DOCUMENTS 677383 8/1952 United Kingdom .

*Primary Examiner*—Alfred C. Perham
*Attorney, Agent, or Firm*—Merchant, Gould, Smith, Edell, Welter & Schmidt

[57] ABSTRACT

An entertainment structure principally intended to comprise a cinematic auditorium. The structure has a horizontally disposed floor or decking support plate on which seating for members of an audience is arrangable and support means on which the support plate is rotatably mounted. Orientation varying means are operable to tilt the support plate, from the horizontal, in a required direction; while drive means are operable to rotate said support plate on said support means about an upwardly extending axis. The structure also includes a drive system operable to actuate said orientation varying means, and control means operable to control actuation of said drive means and said drive system for varying the angular disposition and tilt of said support plate with respect to said axis. In presentation of a cinematic programme, viewers perception of the action is enhanced by such rotation and tilting being synchronized and in concert with visual and aural action of the programme.

28 Claims, 14 Drawing Figures

ENTERTAINMENT STRUCTURE

This invention relates to an improved entertainment structure, and to apparatus for use in such structure.

The invention provides an entertainment structure having a horizontally disposed floor or decking support plate on which seating for members of an audience is arrangable; support means on which the support plate is rotatably mounted; orientation varying means operable to tilt the support plate, from the horizontal, in a required direction; drive means operable to rotate said support plate on said support means about an upwardly extending axis; a drive system operable to actuate said orientation varying means; and control means operable to control actuation of said drive means and said drive system for varying the angular disposition and tilt of said support plate with respect to said axis.

In one convenient arrangement, the support plate is rotatably mounted on a centrally disposed locating column, and also tiltable in any direction by a plurality of extendable and contractable tilt members spaced around the support column. In such arrangement, there may be reversable drive means for reversably rotating the support plate. The drive means may include a drive wheel mounted co-axially with respect to the support column and at least one drive motor connected to the drive wheel for reversably rotating the latter and, with rotation of that wheel, reversably rotating the support plate. The drive motor may be mechanical, electrical, hydraulic or pneumatic but, in any of these forms, it is preferably housed away from the support plate and with drive from the motor for rotating the latter being by means of a drive cable, belt or chain passing around the drive wheel.

The extendable/contractable tilt members, of which there preferably is at least three, may be upwardly mounted jacks, which are hydraulically or pneumatically operable. The lower ends of the tilt members may be mounted on a basal support spaced below the support plate, with their upper ends bearing against the undersurface of the support plate. To accommodate rotational movement of the support plate, the upper end of each tilt member may have a roller means across which the support plate runs during its rotation. On the surface of the support plate, there may be an arcuate or circular track or rail against which such roller means is in rolling engagement.

The tilt members each may be operable under the action of a drive system so as to selectively extend or retract, as required. Simultaneous operation of two or more of the members preferably is inter-related so as to provide tilting of the support plate in a required direction. The drive system may be pneumatic, hydraulic, mechanical or electrical.

The foregoing structure may be used for cinematic purposes. It thus may include a screen extending upwardly adjacent an edge portion of the plate. In one suitable arrangement for that purpose, the support plate may be substantially circular, or at least around that edge portion it may be arcuate, with the screen being curved around the plane of the top surface of the support plate. Additionally, the screen may be curved in a direction perpendicular to the support plate, so as to extend upwardly from its lower edge, over the support plate. In one convenient arrangement, the screen may have a viewing face which is at least part spherical, extending for example from about 160° to about 200°, such as about 180°, around the edge of the support plate. The viewing face may curve upwardly from that edge and curve upwardly through about 50° to about 100°, such as from about 60° to about 90°.

In such form of the structure, having a screen, the latter most conveniently is mounted for movement with the support plate during rotation of the latter. However, where the support plate is tiltable it is preferable that tilting, as distinct from rotation, of the support plate be relative to the screen. For such movement of the screen during rotation of the support plate, the screen may be mounted on rollers, at its lower edge, and the latter preferably run on a guide rail or in a guide track. To ensure movement of the screen with rotation of the support plate, the two members preferably are coupled together; although they can be moved separately to maintain the required relationship, by means of respective drive motors whose outputs are uniformly regulated.

In one convenient arrangement, the support plate and screen are mechanically coupled together, but with a single drive motor rotating the support plate and thereby moving the screen therewith. Where the support plate also is tiltable, a coupling preferably allows for this without corresponding movement of the screen. In one form of such arrangement, the support plate may have radially extending arms which pass through vertical slots in a lower region of the screen such that, in rotation of the plate, the screen is moved with it but such that, on tilting of the plate, the arms simply move upwardly or downwardly in the slots without corresponding movement of the screen. In another form of such arrangement, the support plate and screen may be connected by sets of link members, with the links of each set being inter-connected so as to be bendable in a vertical plane to allow tilting of the plate relative to the screen, but fixed against bending in a horizontal plane so as to constrain the screen to move with the plate during rotation of the latter.

In one form, the screen has a backing membrane and, applied over at least one major surface of the membrane so as to be bonded or mechanically engaged therewith, a facing material which defines a viewing face for the screen. The screen may include a frame by which it is supported, preferably a frame of skeletal form corresponding substantially to a required shape for the membrane and facing. The membrane may be secured to the frame by ties inter-connecting points on the membrane, at its other major surface, and the frame.

The screen preferably is curved horizontally and vertically such as to have a concave viewing face. Most preferably, the viewing face has a substantially uniform radius of curvature so as to be of, or approximate to, a part spherical form.

The screen may be formed by the membrane being held under vacuum in a required configuration, and the facing material applied over a major surface of the membrane while the latter is so held. Where the screen is to have a concave viewing face which is curved both horizontally and vertically, it may be necessary to form the membrane from a number of precut, and possibly pre-shaped, panels and to secure successive panels together along respective edges to provide a continuous membrane.

The membrane may be secured around its edges, such as to a frame, and a vacuum applied to the other of its major surfaces to draw it into the required configuration. For this purpose, a chamber may be provided by the membrane and a backing member, with the frame preferably between the membrane and backing member. Air then is withdrawn from the chamber so as to draw the membrane toward the frame and into such configuration. The backing member also may comprise a membrane. While the membrane of the screen is held in that configuration, the facing material then is applied to it.

The membrane for the screen may be formed of sheet rubber or plastics material. Alternatively, it may be formed of woven or non-woven textile material. However, in the latter case, the membrane is pre-treated to make it imperforate, such as by application of a filler or surface coating material. The filler material may comprise a suitable heat or air curable emulsion or solution, or it may comprise a pre-coating of facing material.

The facing material may comprise at least one layer of at least one spray coatable material. Suitable materials include paper mache, plaster, mineral wool, and plastics materials such as epoxy resins and polyurethanes including foamable urethanes.

A projector, or projector system, may be mounted for movement with the support plate, during reversable rotation of the latter. The arrangement most conveniently is such that during the viewing of a cinematic programme, the support plate on which seating for an audience is arrange, can be moved by being rotated in either direction and/or tilted as required in selected directions. Such movement can be integrated with action of the cinematic programme so as to heighten the perception of members of the audience of movement otherwise perceived only visually and aurally.

The structure may further include control means operable to integrate movement of the support plate with action depicted in the cinematic programme. The control means may be operable to control operation of the drive means effecting reversable rotation, and the drive system for effecting tilting of the support plate. The control means may be operable independently of, but in synchronism with, a cinematic programme action being viewed. Alternatively, the control means may be operatively integrated with the cinematic programme, and operable in response to a signal recorded on and received from film used in projecting the cinematic programme or in response to sync pulses generated from the projector. Most conveniently, the control means is a microprocessor for which, in either case, the projector or projector system sets timing pulses to cue the microprocessor.

In the overall arrangement of the structure described above, the structure may be a permanent installation. In such case, the drive means and power generating means of the drive system may be in a first enclosure spaced from a second enclosure housing the support plate; the enclosures being separate parts of a single building or associated respective buildings. However, in a variant of the invention, the structure may be partially or completely demountable; with the drive means and such power generating means preferably installed in a mobile unit, such as a van or truck.

In one form, the entertainment structure has an audio speaker system for reproduction of a multi-channel audio programme, the system including a respective speaker unit on each channel of the multi-channel programme, with speakers mountable so that each faces outwardly in a respective direction from a central location.

In use, the speaker system typically is placed in a central location, with each speaker unit facing so as to direct its output in the respective direction toward an opposed wall surface so as to rebound from the latter. The system most conveniently is so located and adapted so that persons listening to the programme receive the output from each speaker unit after it has rebounded; the programme thus being perceived as full-surround sound.

The support plate of the entertainment structure most preferably is housed in a dome shaped enclosure, and the latter is well suited to use of such speaker system since, when centrally located in such enclosure, all speaker units are substantially the same distances from opposed wall surfaces. However, to ensure that the output of each speaker unit is received by listeners after rebounding from such surface, the speaker system preferably is mounted at a central location above the listeners. Most preferably, the speaker system is mounted centrally at the top of the enclosure and, in such case, it may depend from a roof or ceiling surface.

The number of speaker units preferably is at least four. The number preferably is such as to provide an impression of a substantial continuum of sound, rather than discrete sound sources, when the output of each speaker is the same in content and sound level. For a dome shaped enclosure, six speaker units generally are adequate, although from four to ten, depending on the size of the enclosure, can be used.

Each speaker unit may have distinct enclosure and at least one driver therein; while the speaker enclosures may be connected together or separate. Alternatively, the speaker units may have a common speaker enclosure, with the volume of this preferably being divided such as by baffles therein.

The speaker system may have external baffle means for constricting the cone of sound waves emanating from each speaker unit. The baffle means preferably is operable to limit the angle of that cone, at least in a vertical direction, to ensure that substantially all sound passes to persons listening to the programme after rebounding from opposed wall surfaces. Thus, when the system is mounted above such persons, at least one lower baffle preferably is provided to ensure that the output from each speaker unit strikes its opposed wall surface above the heights of those persons and rebounds from that surface down to the listeners.

The invention also provides a device for use in recording an audio programme for use with such speaker system. The device comprises a controller for a multichannel recorder and includes, for each channel of the recorder, a respective slide means movable to adjust the signal strength for its channel, each slide means being disposed around a central control lever so as to be movable radially with respect to the lever, with the lever being pivotable around a central fulcrum point to adjust the positions of the slide means.

The control lever may be upstanding and pivotally mounted at its lower end. Most conveniently it is contacted at all times by movable member of each slide means, such as by the movable members each being biased to an innermost position with respect to the extent of its movement radially of the control lever. The control lever may have a circular disc concentrically mounted thereon, with the movable member of each slide means engaging the periphery of the disc.

Each slide means may comprise variable resistance means connectable to a source for a signal to be recorded and to a respective input for a multi-channel recorder. The arrangement may be such that with the control lever in a central position, the movable member of each slide means is at an intermediate position in which it permits a signal of corresponding strength to pass from the signal source to its input of the recorder and so that, in pivoting of the control arm from that position, that strength can simultaneously be increased and decreased for opposed ones of the slide means; the device thus functioning as a selective fader. The device preferably is such that it can be pivoted and rotated with respect to its fulcrum point, such as to provide a sweeping action in which signal strength for successive slide members circumferentially of the lever can be adjusted.

In order that the invention may more readily be understood, reference now is made to the accompanying drawings, in which.

Figure 6:
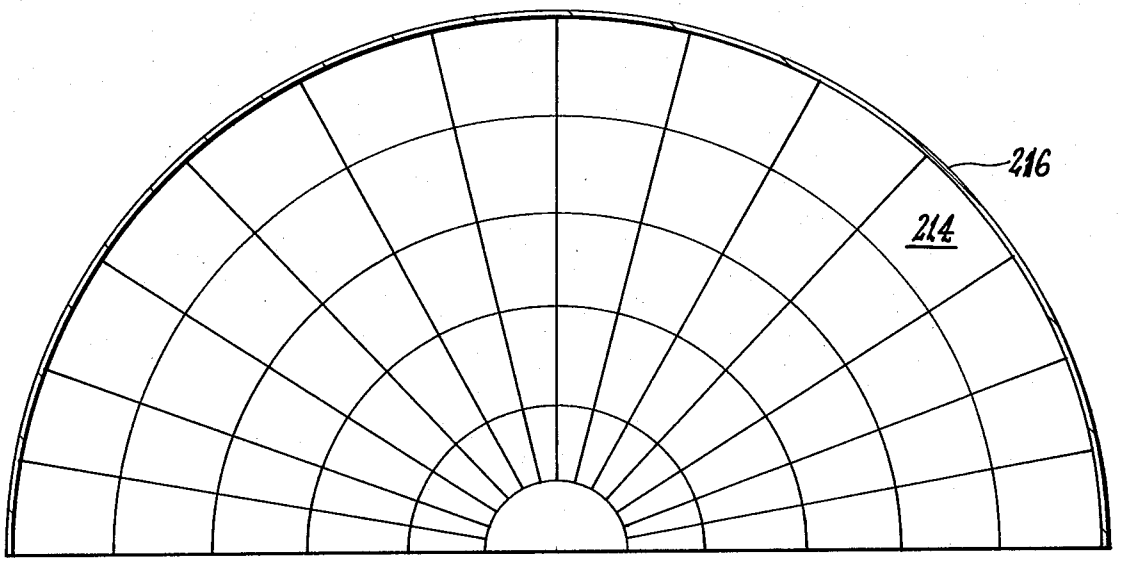
Figure 12:
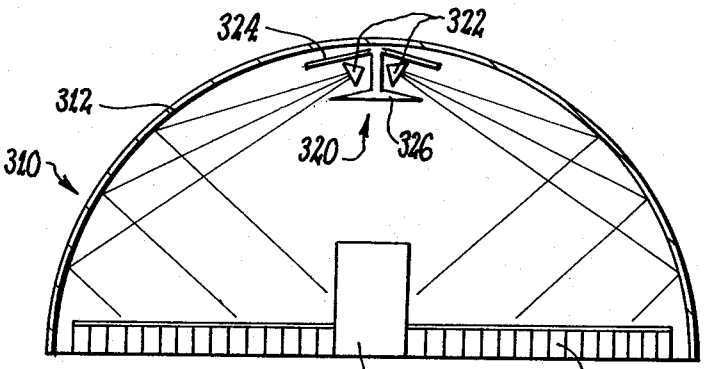
Figure 13:
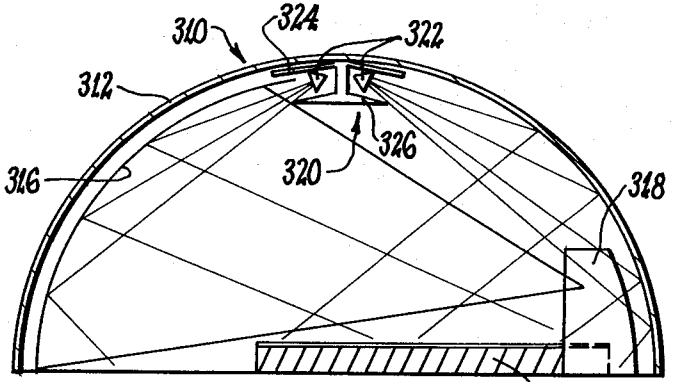
Figure 11:
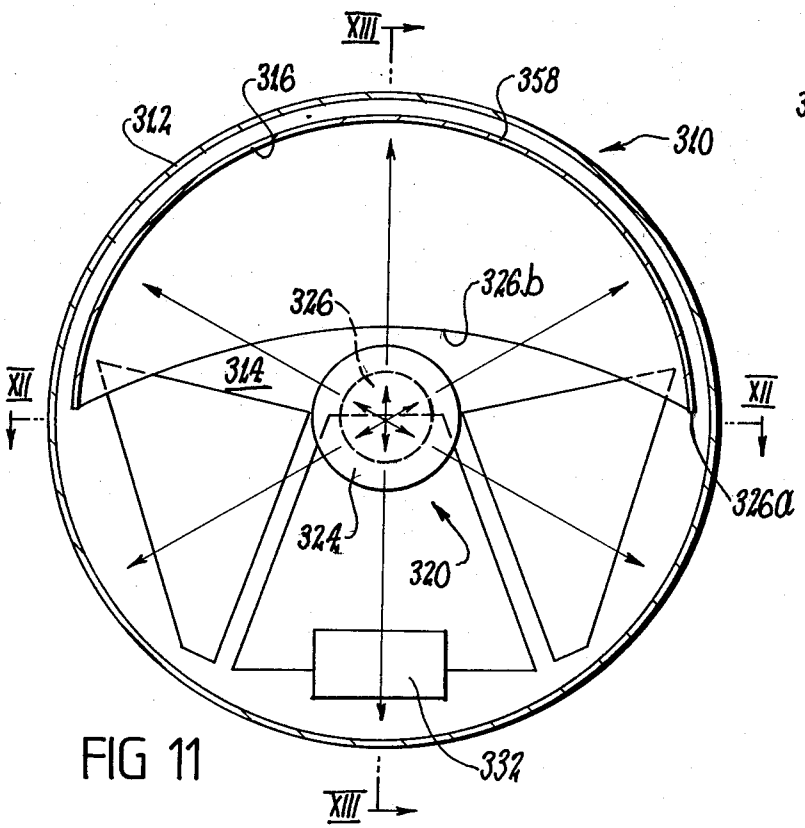
Figure 14:
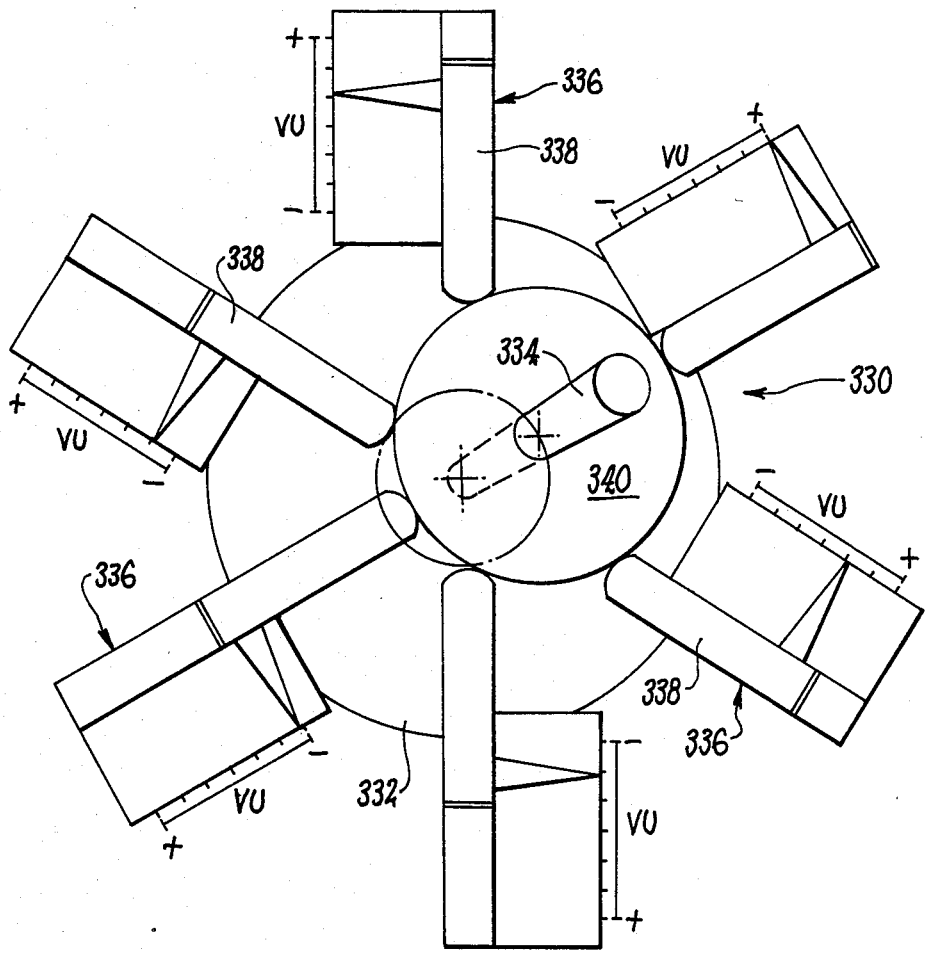

FIG. 6 schematically illustrates, in front elevation, one form of screen;

FIGS. 7 to 10 show, on a transverse section of FIG. 6, successive stages in formation of the screen;

FIG. 11 shows an auditorium having a preferred form of speaker system;

FIG. 12 is a vertical section on line XII—XII of FIG. 11;

FIG. 13 is similar to FIG. 12, but taken on line XIII—XIII of FIG. 11; and FIG. 14 is a schematic representation of a recording device for use in accordance with the invention.

The structure 10 of FIGS. 1 to 4 has an auditorium 12, a control room 14 and an elongate connecting passage 16 therebetween. Auditorium 12 is in the form of a larger hemisphere, with room 14 being a smaller hemisphere. Each hemisphere has a respective outer shell 18, 20, which may be of rigid construction, or an air-pressure supported dome structure. Passage 16 may, for example, be defined by an elongate enclosure of inverted-U cross-section.

Shells 18, 20 stand on a base 22 which may be continuous under passage 16. Within shell 18, there is a support plate 24, defining flooring of circular form for auditorium 12. Blocks A, B, C of seating arranged on plate 24 face toward part spherical cinema screen 26, also within shell 18.

Plate 24 is located on a central column 28 mounted in base 22, while plate 24 also is supported on three jacks 30 spaced equidistantly from, and uniformly around, column 28. Jacks 30 have their cylinders mounted in base 22, with their extendable/retractable rods bearing against the lower surface of plate 24. A circular load bearing track 31 on that surface is engaged by a roller rotatable on the upper end of the rod of each jack 30.

Plate 24 is reversable rotatably on locating column 28 such as by a collar connected to plate 24 being rotatably received on column 28. While plate 24 normally is horizontally disposed on column 28, it is reversably tiltable, such as through an angle of 5° to the horizontal, under the combined action of rams 30. Between column 28 and plate 24 there may, for example be a universal action thrust bearing enabling such rotation and tilting movements. Such movements preferably are able to be effected separately or simultaneously, as required.

Also within shell 18 there is, at the rear of the auditorium with respect to screen 26, a projector housing 32 and a cinematic projector 34 therein. The projector operates in the conventional manner in relation to screen 26, but its housing 32 is mounted on and movable with platform 24 so as to maintain a steady image relative to members of an audience seated in blocks A, B, C. Screen 26, due to its part spherical form, curves substantially concentrically around the periphery of plate 24, through about 180° between its ends 26*a*, while screen 26 also curves upwardly over plate 24 through about 80° from its lower edge 26*c* to its top edge 26*b*.

Machinery for movement of plate 24 is located in shell 20 of control room 14. The machines include continuously operating clockwise hydraulic drive motor 36 and similar anti-clockwise motor 38, operable to selectively rotate drive wheel 40 and, via drive cable 42, slave wheel 44 mounted coaxially on column 28. A rotatable sleeve on column 28 couples wheel 44 to plate 24; the overall arrangement being such that motors 26, 28 are selectively operable to rotate plate 24 clockwise or anti-clockwise.

Cable 42 may be a loop passing around each of wheels 40, 44 with at least one run, but preferably each run, thereof tensioned by a jockey roller 46. Rollers 46 may be biased to provide such tensioning, such as by a pneumatic or hydraulic actuator 48, or by equivalent means.

Motors 36, 38 also supply hydraulic fluid for actuation of jacks 30. Supply and return of that fluid is via fluid lines 50, and is regulated by valves provided in hydraulic switching block 52. Operation of jacks 30 preferably is such that tilting of plate 24 is effected by each of jacks 30 operating in unison. Thus, tilting of plate 24 from the horizontal position shown in FIG. 1, such that it remains symmetrically disposed with respect to screen 26, can be effected by retraction (or extension) of the left hand jack 30 and equal extension (or retraction) of the other two jacks 30. However, tilting may be asymmetrical with respect to screen 26, such as by non-equal actuation of selected jacks 30. As will be appreciated, plate 24 can be tilted in any direction by appropriate operation of jacks 30.

Screen 26 has rollers 56 at spaced locations around its lower edge so that it is circumferentially movable on base 22. Rollers 56 run on an arcuate rail or track 58 on the surface of base 22 to guide screen 26 in such movement. Screen 26 is rotatable reversably about column 28, with plate 24, so that screen 26 and plate 24 remain in constant angular relationship but with plate 24 being tiltable relative to screen 26. Such rotation of screen 26 can be effected by drive means, such as motors 36, 38 or other motors, independently of drive of plate 24. However it is preferred that plate 24 and screen 26 are interconnected in a manner, such as herein described, which ensures their rotation in unison by the action of motors 36, 38 on plate 24 only, while allowing plate 24 to tilt relative to screen 26.

Auditorium 12 and control room 14 are spaced by passage 16 so that noise from motors 36, 38 is minimised in auditorium 12; although other arrangements can be used. However, the arrangement illustrated also enables the constructional and operational features of auditorium 12 to be simplified, with passage 16 providing an entrance 60 to structure 10, a foyer 62, and an amenities block 64. Also cable 42 and fluid lines 50 can pass from control room 14 to auditorium 12 below floor level.

The projector 34, as well as motors 36, 38 and the valves of switching block 52 are controlled by a microprocessor of control computer block 66. A computer programme stored in or fed to block 66, which is synchronised with action depicted in a given cinema programme to be shown by projector 34, can be used to effect rotation and/or tilting of plate 24 during projection of the cinema programme in synchronism with action depicted in the latter programme. Alternatively, the computer programme can be recorded on the film to be run through projector 34, with data from that programme being progressively passed to the microprocessor to enable rotation and/or tilting of plate 24 to be effected. In this manner, members of the viewing audience in auditorium 14 can experience movement which is synchronised with action depicted in the projected cinema programme and thereby enhances overall perception of that movement beyond simple visual and aural perception.

It is intended that motors 36, 38 be able to provide variable drive such that the movement experienced by members of the audience can be varied and, by interaction of the operation of motors 36, 38 such that a degree of acceleration or deceleration can be experienced. It also is intended that tilting of plate 24 be capable not only of variation in direction, but also in the rate of tilting and return to the horizontal or change in the direction of tilt. In the latter regard, it will be appreciated that, with out of phase extension and retraction of successive jacks 30, the radial direction of maximum tilt can be caused to sweep around plate 24, reversably if required. Also, tilting in combination with rotation can be used to create a perception of movement which, reinforced with visual and aural effects, can be significantly greater than the extent of actual movement.

While rotation and tilting of plate 24 is described as being hydraulic, it can as previously indicated be provided by pneumatic, mechanical or electrical drive means. However, hydraulic drive has the benefits of being capable of being precisely controlled, substantially instantaneously reversable and smoothly varied in terms of the rate of rotation or tilting. Thus, in relation to tilting, the computer programme can, for example, provide slow smooth tilting through a maximum tilt angle, or rapidly reversed tilting through a smaller angle.

Figure 5:
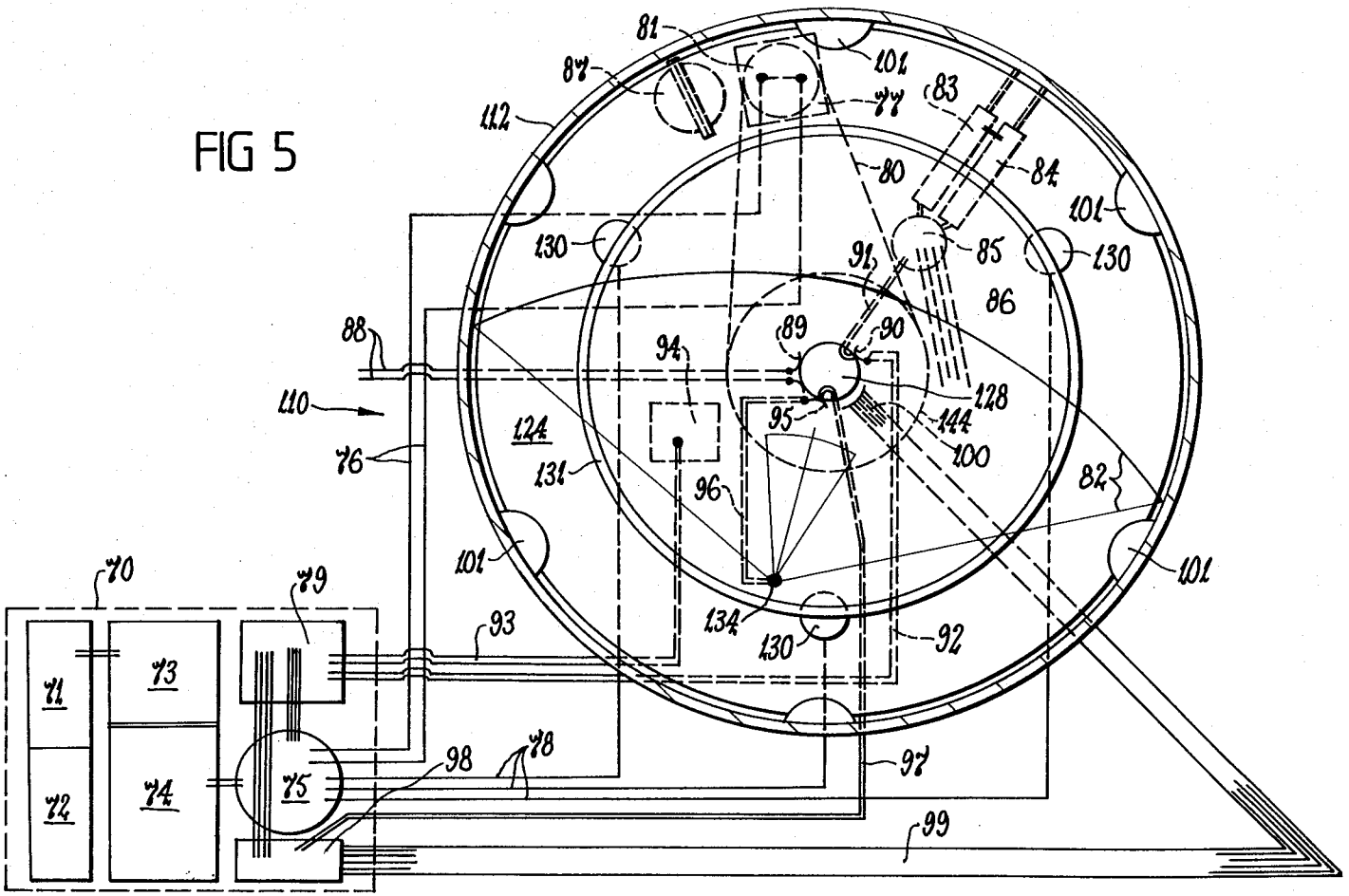
FIG. 5 is a schematic plan view of an entertainment structure according to a second embodiment.

FIG. 5 shows a variant of the entertainment structure in which parts corresponding to those of structure 10 of FIGS. 1 to 4 are identified by the same reference numeral, plus 100. Structure 110 of FIG. 1 comprises an auditorium 112, although some control and drive components for this are housed in a mobile van or truck 70 depicted by broken outline.

Auditorium 112 is a hemispherical form, and has circular flooring defined by support plate 124 rotatable on central column 128. Jacks 130 support plate 124 radially outwardly of column 128 with the mounting of plate 124 on column 128 enabling tilting of plate 124 from the horizontal, as described in relation to structure 10 of FIGS. 1 to 4.

Van 70 houses a compressor 71 driven by motor 72 to supply pressurized air to reservoir 73. Air in reservoir 73 pressurized hydraulic fluid in reservoir 74; the latter providing actuating hydraulic fluid to controller 75, and from the latter, via lines 76 to reversable hydraulic drive 77 and via lines 78 to jacks 130. Actuation of controller 75 is by means of microprocessor 79, also housed in van 70.

Drive 77 is mounted below plate 124 and is reversably rotatable under the action of hydraulic fluid received from lines 76. A belt 80 passing around drive wheel 81 of drive 77 also passes around driven wheel 144 mounted co-axially on column 128. Again, a rotatable sleeve on column 128 couples wheel 144 to plate 124 such that drive 77 is able to selectively rotate plate 124 clockwise or anti-clockwise.

In the arrangement of FIG. 5, auditorium 112 is similar in form to auditorium 12 of FIGS. 1 to 4. However, the inner surface of auditorium is treated to provide a screen viewing face against which projector 134 is able to project an image, represented by light cone 82, a separate screen such as screen 26 of FIGS. 1 to 4 not being provided (but able to be provided is required).

Figure 1:
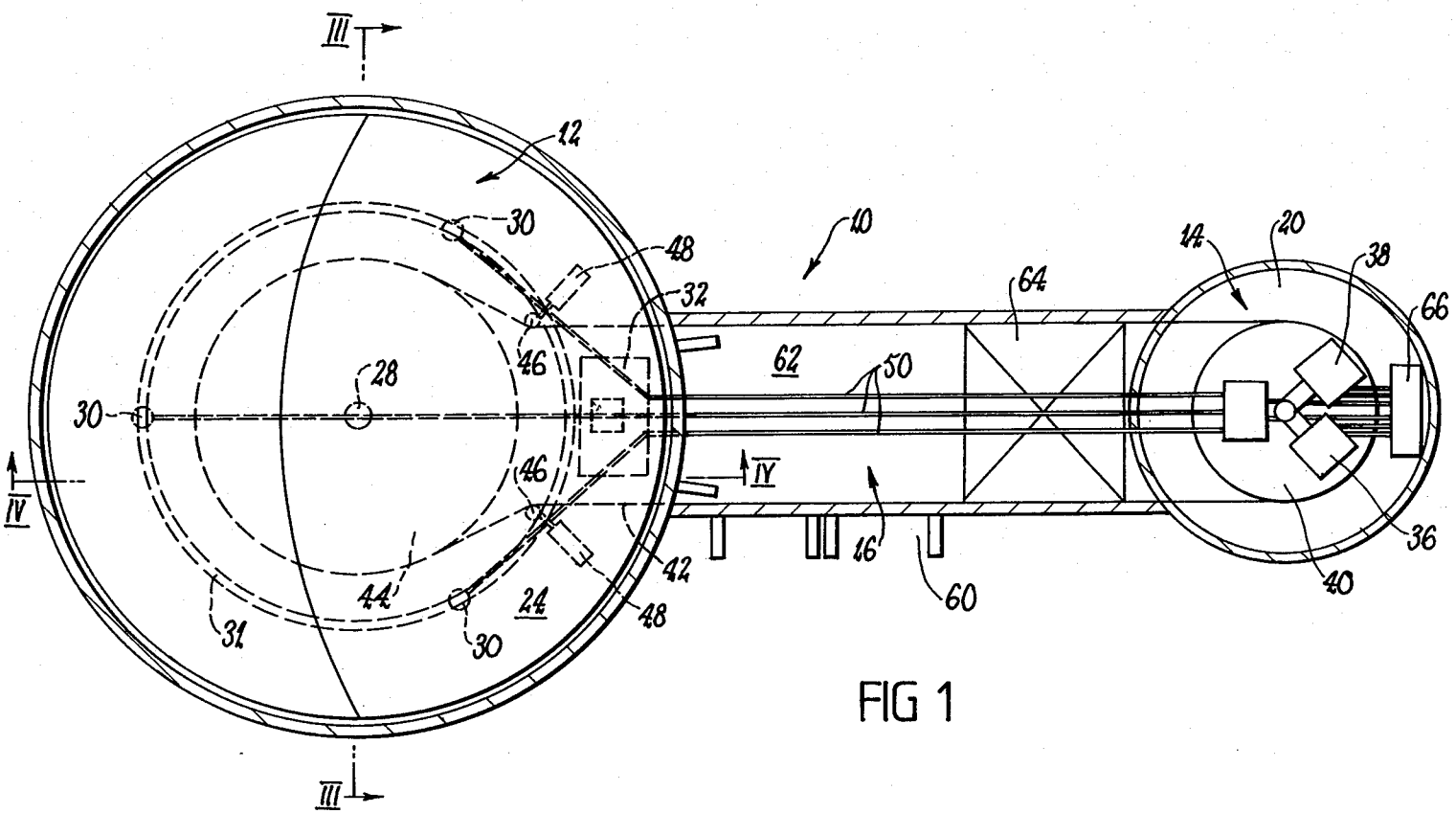
FIG. 1 is a schematic plan view of a first embodiment of an entertainment structure according to the invention.
Figure 2:
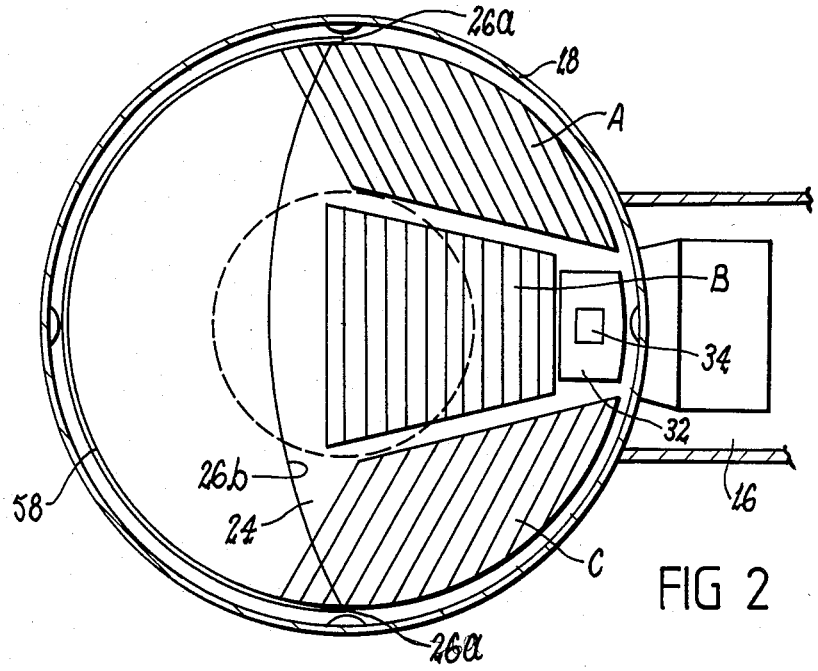
FIG. 2 shows a schematic plan view, with further detail, of the left hand end portion of FIG. 1.
Figure 3:
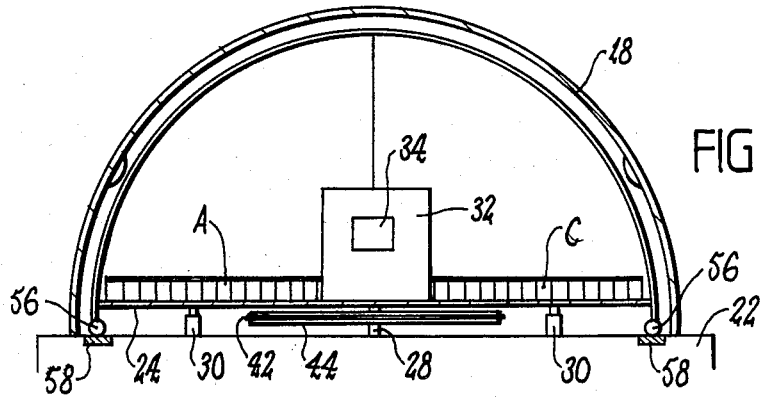
FIG. 3 shows a schematic sectional view taken on line III—III of FIG. 1.
Figure 4:
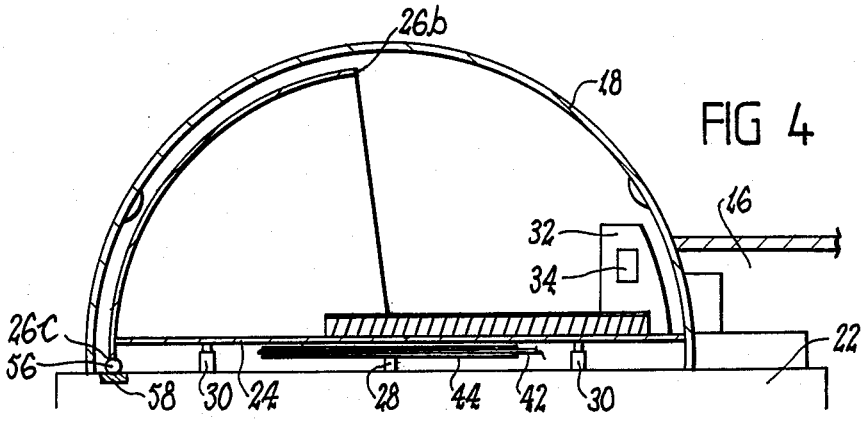
FIG. 4 is a sectional view taken on line IV—IV of FIG. 2.

Within auditorium 112, pneumatic over hydraulic reservoirs are mounted on the underside of support plate 124. Those reservoirs comprise an air reservoir 83 and an hydraulic liquid reservoir 84; air pressure in the former maintaining liquid in the latter under pressure to seat actuator member 85, and from the latter to each seat on plate 124 via a respective mini-bore tube 86. Each seat, such as in blocks of seats A, B, C as in FIG. 2, is supported on a mast comprising a short amplitude jack enabling the seat to be oscillated vertically. Member 85 may comprise a bank of solenoid or similar switches each operable to open and close a respective tube 86 for effecting such oscillation. However, member 85 preferably comprises a proportional hydraulic control operable to enable supply of hydraulic fluid to tubes 86 for effecting such oscillation of the seats over a variable amplitude.

Reservoirs 83, 84 and members 85 rotate with plate 124. An air compressor 87 fixed below plate 124 has a pressurized air outlet engagable with an inlet valve on reservoir 83 when plate 124 is rotated to a zero position and pressure in jacks 130 is released, thereby enabling air pressure in reservoir 83 to be replenished periodically on lowering of plate 124.

Electric power for auditorium 112 passes from a supply thereof, via lines 88 t slip rings 89 engaging a collar on column 128; while power requirements for van 70, air-conditioner 94 and projector 134 are separately provided. Actuation of member 85 is controlled by cueing pulses from microprocessor 79, via line 92, slip ring 90 and line 91. Microprocessor 79 also provides cueing pulses, via line 93, to air-conditioner 94; the arrangement being such that air-conditioner 94 is able to provide heating or coolling in auditorium 112 consistent with the environment in which action, depicted in a cinematic programme from projector 134, is conducted. Thus, if that action changes from action in a desert, to action in snowfields, microprocessor 79 simultaneously reverses operation of air-conditioner 94 from a heating to a cooling cycle. Also, microprocessor 79 provides cueing pulses, via presentation/computer amplifier 98, line 97, slip ring 95 and line 96, for projector 134. Amplifier 98 in van 70 provides a six-channel audio-output via lines 99 to a central location 100; while each line 99 is connected from location 100 to a respective speaker unit 101 mounted on the hemispherical dome enclosing auditorium 112.

The perception of movement possible with the invention can be used to heighten and extend a viewer's awareness of movement depicted in a cinematic programme, and thereby create a stonger impression of being in the action depicted. Thus, in following a projected image of a person skiing down a ski-slope, rapid variation in tilt of plate 24 and/or seat vibration can impart a perception of vibrations experienced by the skier and also undulations in the slope, while variation in the angle of tilt in combination with rotation of plate 24 can impart a greater awareness of the skier turning. A wide variety of other forms of actions depicted by the projected image can be stimulated by rotation and/or tilting of plate 24, thereby enhancing the overall perception of viewers of being in the action.

A sound system for structure 10 most conveniently also is controlled by the microprocessor such that, with the depiction of visual action involving a change in orientation of the audience, perception of the sound is consistent with that change. Most preferably, a multi-track sound system such as a six track system is used, with the computer being operable with a change in orientation, to adjust the balance between individual speakers in a manner consistent with that change. Thus, in a film depicting a vehicle chase as perceived from a pursued vehicle, a change in such vehicle through 90° may, for example, be simulated by rotation of plate 24 and screen 26 through only 45°, but in synchronism with this the microprocessor may adjust the balance between speakers generating the sound of a siren or a pursuing vehicle to more realistically represent a 90° change of direction and, once the latter vehicle has cornered, then adjust the balance back to the former pursuit setting.

While not illustrated, the audience seating in blocks A, B, C can be modified to further enhance perception of the audience. Thus, individual seats can incorporate hydraulic and or pneumatic rams which provide tilting in the forward/reverse direction and/or sideways tilting and/or a degree of vertical movement of the seats. Such arrangements can be additional, or alternative to tilting of plate 24. Also, pneumatic or hydraulic fluid for such seat movement can be provided under the control of the microprocessor, and synchronised with the ongoing projected cinematic programme.

While motors 36, 38 are shown as remote from auditorium 14, other arrangements are possible. Thus, subject to noise level, hydraulic or other forms of motors may be located below plate 24. Alternatively, with hydraulic drive, a pump or motor providing pressurized fluid can be located remote from auditorium 14, with the fluid passing via supply lines to a hydraulic actuator below plate 24 for rotation and tilting of the latter, and from the actuator via return lines to the remote location.

In a further variant of the invention, screen 26 may be fixed and for example extend fully around plate 24.

The auditorium may, in substantially conventional procedure be air-conditioned for audience comfort. However, variation in operation of air-conditioning plant may be controlled by the microprocessor, while air from that plant can be supplied from below plate 24 through slots or openings in that plate.

The screen 210 of FIG. 6 is of substantially quarter spherical form, and includes a skeletal frame 212 and a viewing face 214 formed thereon. Frame 212 has a series of semi-circular ribs 216 inter-connected by arcuate ribs 218; with the lower ends of ribs 216 preferably inter-connected by a horizontally disposed semi-circular base member or rib (not shown). Ribs 216, 218 may be inter-connected at their intersections by welding or by clips or ties. Face 214 is within, and conforms generally to, frame 212 and has a concave part spherical form.

Figure 7:
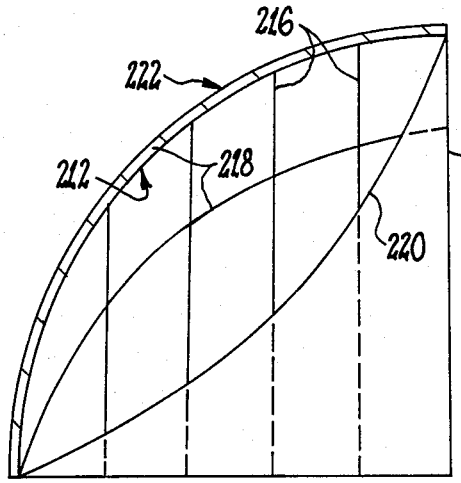

Frame 212 first is erected. As shown in FIG. 7, a membrane 220 then is secured around the horizontal and vertical edges of frame 212, and a covering skin 222 extending over frame 212 also is secured to those edges. Membrane 220 and skin 222 define a chamber 224 containing frame 212.

Figure 8:
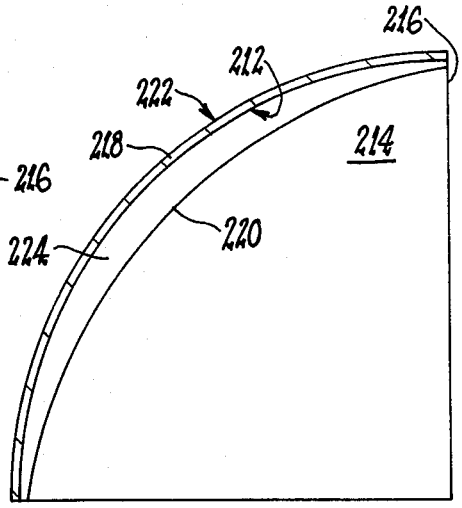
Figure 9:
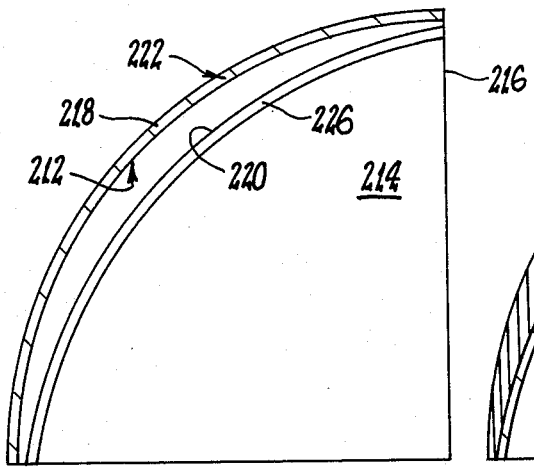

As shown in FIGS. 8 and 9, air is drawn from chamber 224 to form a partial vacuum. As a consequence, membrane 220 is sucked into a concave form and, while held in that form, a layer 226 of hardenable facing material is sprayed substantially uniformly over membrane 220 and set, cured or hardened by drying. Layer 226 may require successive layers, of the same or a different material to provide sufficient structural integrity for the layer to be self supporting.

Figure 10:
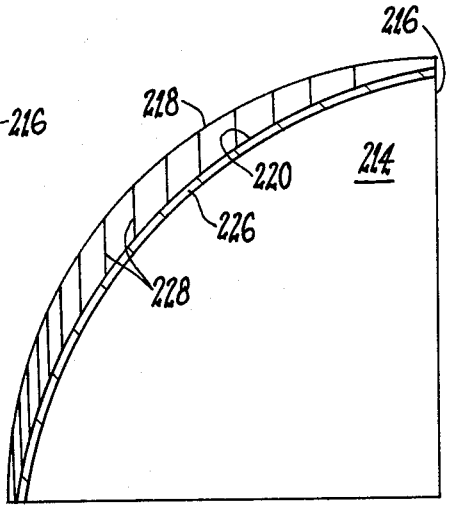

Skin 222 then preferably is removed and, as shown in FIG. 10, ties 228 are fitted to secure the assembly of membrane 220 and layer 226 to frame 212. The ties may be cords or lengths of metal or plastics connected to projections on membrane 220 and to rib 216, 218. Alternatively, ties 228 may be bonded or welded to membrane 220 and connected to such rib. In a further alternative, ties 228 may be inserted through layer 226 and membrane 220 and then pass to a rib 216, 218 and be connected to the latter, with ends of the ties at layer 226 being covered by a further application of facing material.

Ribs 216, 218 may be metal rod or tubing, such as of steel or aluminium. Membrane 220 may be of plastics sheeting, canvas or fabric such as synthetic plastics, typically used in sail-making. Membrane 220 may be tailored from sections which are joined together so that, on being drawn into the required shape or configuration for application of layer 226 thereto, attainment of such shape or configuration is facilitated. Such sections also may be pre-shaped to facilitate attaining such shape or configuration.

Membrane 220 preferably is substantially imperforate so that it can be drawn by application of a partial vacuum. If made of relatively open woven or non-woven fabric, it therefore preferably is filled by application of a filler, sizing or surface coating material to make it substantially imperforate.

The surface of membrane 220 to which the partial vacuum is applied may have projecting hooks or the like to facilitate connection of ties 228 thereto. Such hooks or the like may be formed integrally with membrane 220, or they may be secured thereto such as bonding. Also, on its surface to which layer 226 is applied, membrane 220 may have keying elements formed integrally thereon or secured thereto; such elements projecting from membrane 220 and being imbedded in layer 226 so as to secure the latter to membrane 220. The keying elements may be short projections which, at their outer ends, preferably have an enlargement ensuring they are securely imbedded in layer 226.

Once layer 226 has set, hardened or cured, its outer face may be treated to achieve the required smoothness over face 214 for use of the latter as the viewing face for a projected cinematic perogramme. Face 214 also may be treated to provide the required degree of reflectivity for viewing of such programme projected thereon.

If necessary, the strength of the screen can be increased by applying a suitable coating over the back of membrane 220; that is, over the surface of the latter remote from layer 226. While it is desirable to take care in forming layers 226, due to the need to achieve a smooth final face 214, this need does not exist with the back surface. The coating applied to the back preferably is fibre-reinforced resin, such as glass reinforced epoxy. Most conveniently the back coating is applied from the base of the screen upwardly; while ties 228 can be embedded in this coating, and secured therein when the coating cures.

With reference to FIGS. 11 to 13, auditorium 310 generally is as described in relation to FIGS. 1 to 4 and also FIG. 5, having an external dome 312 of hemispherical form, and a floor 14 which is movable in the manner described in respect of those Figures. A screen 316, of part spherical form, is mounted in dome 312 such as in substantially concentric relation with the latter; while a projector housing 318 is positioned to project a cinematic programme on to screen 316.

Located centrally within the auditorium, a speaker system 320 is mounted on dome 312 and depends from the latter. System 320 includes a uniformly disposed array of six speaker units 322, each facing radially outwardly and downwardly toward the side of dome 312. System 320 also includes upper and lower baffles 324, 326 which constrict the vertical angle of the cone of sound waves from each unit 322 so that all sound passes to the audience area substantially only after reflection from the sides of the dome 312. Members of the audience thus perceive the sound from system 320 as coming from all directions and, unless the output of any one unit 322 differs significantly in content or volume, a full-surround impression of sound is provided.

With reference to FIG. 14, the device 330 comprises an annular base 332, an upwardly extending control lever 334 pivoted centrally at its lower end within base 332 and, around the circumference of base 332, a plurality of slide members 336.

Each member 336 is adapted to be connected to a source of a signal to be recorded on a multi-channel recorder, and to pass that signal to a respective input channel of the recorder. A slide 338 of each member 336 is radially slidable to vary the strength of the signal it receives, and is resiliently biased radially inwardly; the signal strength increasing or decreasing in dependence on the radial position of slide 338 (the direction not being material).

Lever 334 carries a concentric disc 340 against the edge of which each slide 38 is biased. The arrangement is such that pivoting of lever 334 on its lower end enables variation of the signal strength for selected members 336 in opposed pairs thereof.

Members 336 are operable as faders. Lever 334 is movable abouts its fulcrumed lower end, and can cause each of the faders to be activated when lever is directed toward a fader, and a spring bias provides a self-return in the reverse direction when the lever is returned. When lever 334 is centrally located, all faders can be operable at an intermediate signal strength and, as the lever is moved fully toward one member 336 the latter can be fully open (or fully closed) and its opposite fader fully closed (or fully open). Intermediate positions have a proportional effect on signal strength; with control over blending of sound through all recorder inputs being possible.

Device 330 can be used in recording a programme for the speaker system fo FIGS. 11 to 13. A sound engineer is able to manipulate a bank of devices 330, each connected to a respective sound source and to the inputs of a single recorder, to record sounds in synchronism with action of a film track to provide a final multi-track recording for the filmed action. Thus, the sound recording can be controlled to provide a programme for which perception of sound source for members of the audience can be changed, in accordance with changes in special perception of viewed action. In the structures described in relation to FIGS. 1 to 4 and FIG. 5, a viewing audience can be caused to believe they are present in action being viewed due to movement of the auditorium floor, and this can be enhanced by changes in actual sound between speaker units 322 being synchronized with spatial changes in the viewed action perceived by the audience.

The baffles 324, 326 preferably are of sound absorbing material, such as foamed plastic material. Baffle 326 is to ensure that sound is reflected from dome 312 (and also screen 316) above the audience level. Baffle 324 is to ensure that little if any sound is reflected directly downwardly to the audience, so that substantially all sound is perceived as coming horizontally. However, system 320 can include at least one speaker unit which does direct sound directly downwardly such that, when used, a directly overhead sound can be provided; and such at least one unit can, for example, be mounted on the underside of baffle 326.

The speaker system 320 of FIGS. 11 to 13 is preferably used in the auditorium of FIGS. 1 to 4 and that of FIG. 5, in providing full-surround sound. In addition to providing such sound, system 320 enables accurate control of the directionality of selected sounds, when required, as well as changes in directionality. However, system 320 also has the important advantage of enabling the attainment of substantially constant sound level, and balance between sound from individual units 322 of system 320, at all listening positions throughout the auditorium.

Finally, it is to be understood that various alterations, modifications and/or additions may be introduced into the constructions and arrangement of parts previously described without departing from the spirit or ambit of the invention.

We claim:

1. An entertainment structure having a horizontally disposed, substantially circular floor or decking support plate on which seating for members of an audience is arrangable; support means on which the support plate is mounted for rotation about an upwardly extending central axis thereof; orientation varying means operable to tilt the support plate, from the horizontal, in a required direction; drive means operable to rotate said support plate on said support means about said upwardly extending axis; a drive system operable to actuate said orientation varying means; control means operable to control actuation of said drive means and said drive system for varying the angular disposition and tilt of said support plate with respect to said axis; a cinematic screen extending above the level of said support plate adjacent a substantial peripheral portion of the latter, the screen being arcuate in a horizontal plane such that the screen has a viewing face which curves around the periphery of the support plate and which is concave as viewed from the support plate, said screen being mounted in relation to the support plate so that during rotation and tilting of the support plate the latter is at least tiltable relative to the screen; seating for an audience arranged on said support plate and facing toward said screen; and a projector system operable to project a cinematic programme onto a projection area of the viewing face of said screen, said projector system being spaced from said screen beyond said upwardly extending axis and mounted on said support plate for rotation and tilting therewith to vary the location of said projection area on said viewing face; said control means comprising a microprocessor, the projector system being operable to provide timing pulses for the microprocessor by which the latter is operable to integrate rotation and tilting of the support plate in synchronism with cinematic action projected by said projector system onto said screen.

2. A structure according to claim 1, wherein said support means is a centrally disposed column on which said support plate is mounted.

3. A structure according to claim 1, wherein said drive means comprises an reversible drive motor drivingly engaging said support plate and operable to reversably rotate said support plate.

4. A structure according to claim 1, wherein the drive means comprises a drive motor located remote from the support plate, said drive motor being drivingly coupled to said support plate by a drive chain extending therebetween and enabling reversable rotation of said support plate.

5. A structure according to claim 1, wherein said support means is a centrally disposed column on which said support plate is mounted; and wherein the drive means comprises a drive motor located remote from the support plate, the support plate having a driven wheel mounted co-axially with respect to said support column, with said drive chain passing around said driven wheel.

6. A structure according to claim 1, wherein said orientation varying means comprises a plurality of extendable and contractable actuators spaced around the support means, below the support plate, the drive system being adapted to extend and contract said actuators selectively for varying the tilt of said support plate.

7. A structure according to claim 6, wherein each of said actuators is an upwardly mounted jack, the lower end of which is mounted on a basal support for the mounting means, the upper end of each jack bearing against the under surface of the support plate; said drive system being operable to provide pressurized fluid selectively to said jacks for extending the latter.

8. A structure according to claim 7 wherein the upper end of each jack is provided with roller means accross which the support plate runs during its rotation, the under surface of the support plate having a track or rail against which the roller means is in rolling engagement during such rotation.

9. A structure according to claim 1, wherein the periphery of said support plate is substantially circular, said screen extending around said periphery through from 160° to 200°.

10. A structure according to claim 9, wherein the screen extends, around said periphery through about 180°.

11. A structure according to claim 1, wherein said screen curves upwardly over the support plate from the periphery of the latter.

12. A structure according to claim 11, wherein the viewing face of the screen has a substantially constant radius of curvature so as to be part-spherical.

13. A structure according to claim 12, wherein said viewing face extends around the periphery of said support plate through an angle of from 160° to 200°, and upwardly from said periphery through an angle of from 60° to 100°.

14. A structure according to claim 1, wherein said screen and support plate are coupled together such that, with rotation of said support plate, said screen moves with and remains adjacent the peripheral portion of the support plate.

15. A structure according to claim 14, wherein the screen is movable, with said support plate, by rollers at its lower edge being engaged with a guide rail or track.

16. A structure according to claim 14, wherein said screen is coupled to said support plate by coupling means enabling the support plate to be tilted, by said orientation varying means, relative to said screen.

17. A structure according to claim 1, wherein said control means is operable independently of, but in synchronism with, cinematic programme action projected by said projector system such that rotation and tilting of the support plate is integrated with said action.

18. A structure according to claim 1, wherein the support plate is enclosed in a first building section, and a drive motor of the drive means and also power generating means of the drive system are located a distance from said first building section in a second building section.

19. A structure according to claim 1, wherein the support plate is located in a building enclosure, and a drive motor of the drive means and also a power generating means of the drive system are located in the mobile enclosure.

20. A structure according to claim 1, wherein said screen has a backing membrane and, applied over at least one major surface of the membrane so as to be secured thereto, a facing material which defines a viewing face for the screen.

21. A structure according to claim 20, wherein the screen includes a skeletal frame corresponding to the shape of the screen.

22. A structure according to claim 21, wherein the membrane is secured to the frame by ties inter-connecting points on the membrane, at its other major surface, and the frame.

23. A structure according to claim 20, wherein the screen is formed by drawing the membrane under a reduced pressure so that said one surface thereof is concave, and applying the facing material to that concave surface.

24. A structure according to claim 18, wherein said first building section or building enclosure is a dome-shaped enclosure; the structure including a speaker system located within said dome-shaped enclosure at an upper, centrally disposed location; said speaker system having a plurality of speaker units with each unit facing radially outwardly in a respective direction so that its output is able to rebound from the inner surface of said dome-shaped enclosure.

25. A structure according to claim 24, wherein the output of each speaker unit is vertically constrained by baffle means so as to rebound from said inner surface at a height above the level of members of an audience on seating arranged on said support plate.

26. An entertainment structure having a horizontal disposed, substantially circular floor or decking support plate on which seating for members of an audience is arrangeable; support means on which the support plate is mounted for rotation about an upwardly extending central axis thereof; orientation varying means operable to tilt the support plate, from the horizontal, in a required direction; drive means operable to rotate said support plate on said support means about said upwardly extending axis; a drive system operable to actuate said orientation varying means; control means operable to control actuation of said drive means and said drive system for varying the angular disposition and tilt of said support plate with respect to said axis; and a cinematic screen extending above the level of said support plate adjacent a substantial peripheral portion of the latter, the screen being arcuate in a horizontal plane such that the screen has a viewing face which curves around the periphery of the support plate and which is concave as viewed from the support plate; wherein said screen and support plate are coupled together such that, with rotation of said support plate, said screen moves with and remains adjacent the peripheral portion of the support plate.

27. A structure according to claim 26, wherein the screen is movable, with said support plate, by rollers at its lower edge being engaged with a guide rail or track.

28. A structure according to claim 26, wherein said screen is coupled to said support plate by coupling means enabling the support plate to be tilted, by said orientation varying means, relative to said screen.

* * * * *